US008167777B2

(12) United States Patent
Nichols

(10) Patent No.: US 8,167,777 B2
(45) Date of Patent: May 1, 2012

(54) BALANCE AND EXERCISE DYNAMIC SUPPORT BLOCK

(76) Inventor: Susan Nichols, Santa Monica, CA (US)

( * ) Notice: Subject to any disclaimer, the term of this patent is extended or adjusted under 35 U.S.C. 154(b) by 995 days.

(21) Appl. No.: 11/818,141

(22) Filed: Jun. 12, 2007

(65) Prior Publication Data

US 2008/0096740 A1 Apr. 24, 2008

Related U.S. Application Data

(60) Provisional application No. 60/813,135, filed on Jun. 13, 2006.

(51) Int. Cl.
*A63B 21/00* (2006.01)

(52) U.S. Cl. ..... 482/23

(58) Field of Classification Search ..... 482/23, 482/142; 297/451.5, 423.41; 5/630 Y, 636, 5/632, 652, 655, 5, 630, 491
See application file for complete search history.

(56) References Cited

U.S. PATENT DOCUMENTS

| | | | | | |
|---|---|---|---|---|---|
| 4,218,093 | A | * | 8/1980 | Gertz | 297/423.43 |
| 5,029,350 | A | | 7/1991 | Edelson | |
| 5,273,510 | A | | 12/1993 | Puckett et al. | |
| D355,077 | S | * | 2/1995 | Tegner | D6/334 |
| 5,647,829 | A | | 7/1997 | Rivas | |
| D382,372 | S | * | 8/1997 | Castro | D29/124 |
| D384,211 | S | * | 9/1997 | Wied et al. | D6/351 |
| D389,359 | S | * | 1/1998 | Nowak | D6/601 |
| 5,755,647 | A | | 5/1998 | Watnik | |
| 5,842,239 | A | * | 12/1998 | Eckelbarger | 4/523 |
| D406,470 | S | * | 3/1999 | Lin | D6/349 |
| D406,480 | S | * | 3/1999 | Lin | D6/486 |
| 6,324,710 | B1 | * | 12/2001 | Hernandez et al. | 5/630 |
| 6,371,894 | B1 | | 4/2002 | Hill | |
| 6,457,195 | B1 | * | 10/2002 | Holste | 5/636 |
| 6,481,030 | B2 | * | 11/2002 | Bravo et al. | 5/425 |
| 6,578,217 | B1 | | 6/2003 | Roberson | |
| 6,881,179 | B2 | | 4/2005 | Mostardi | |
| 7,033,307 | B2 | * | 4/2006 | Van Straaten | 482/142 |
| 7,472,443 | B2 | * | 1/2009 | Littlehorn et al. | 5/632 |
| 2005/0125901 | A1 | | 6/2005 | Nichols | |
| 2005/0159279 | A1 | | 7/2005 | Stangler | |

OTHER PUBLICATIONS

Abilitatiioms sportime 1995 spring addition p. 31 plug-n-barrel the playing system.*

* cited by examiner

*Primary Examiner* — Jerome w Donnelly
(74) *Attorney, Agent, or Firm* — Roeder & Broder LLP; James P. Broder

(57) ABSTRACT

A support block for supporting the weight of a user above a support surface during exercise includes a support body having a first side, a second side and a support edge. In one embodiment, the first side and/or the second side can be substantially planar and/or can have a substantially similar configuration as one another. The support edge can be substantially orthogonal at least one of the first side and the second side. The support edge includes a curved first section that rollingly contacts the support surface while the support body supports part of the weight of the user above the support surface. The support edge can form at least approximately a 30 degree arc of a circle. In another embodiment, the support body includes a beveled edge positioned between the first side and the support edge. In one embodiment, the support body can be formed substantially from an ethylene-vinyl acetate (EVA) foam material.

9 Claims, 5 Drawing Sheets

BALANCE AND EXERCISE DYNAMIC SUPPORT BLOCK

RELATED APPLICATION

This application claims benefit under 35 U.S.C. §119(e) from U.S. Provisional Patent Application Ser. No. 60/813,135, filed Jun. 13, 2006, the entire contents of which are expressly incorporated herein by reference to the extent permitted.

BACKGROUND

Various forms of yoga and meditation have recently gained acceptance within today's society. For example, Pilates and yoga are known to increase strength and flexibility through holding certain body positions, while different types of meditation exercises encourage relaxation of the mind and body. Quite often, different types of props are used to support the body or parts of the body, and allowing the user to achieve certain poses which would otherwise not be possible. For example, some props are statically positioned between a support surface and a body part of the user to permit a particular pose or stance by the user. However, the benefit derived by the user from these types of props is limited.

SUMMARY

The present invention is directed toward a support block for at least partially supporting the weight of a user above a support surface during exercise. The support block includes a support body having a first side, a second side and a support edge. In one embodiment, the first side and/or the second side can be substantially planar. The support edge can be substantially orthogonal to one or both of the first side and the second side. The support edge can include a curved first section that rollingly contacts the support surface while the support body at least partially supports the weight of the user above the support surface.

In one embodiment, the support body is non-hollow. In some embodiments, one or both of the first side and the second side have a substantially circular configuration. The first side can have has a first diameter and the support edge can have a width that is substantially perpendicular to the first diameter. In one embodiment, the width can be least approximately 25% of the first diameter. The first side can be substantially parallel with the second side. The support edge can be substantially orthogonal with the first side and the second side. The first side and the second side can have a substantially similar configuration as one another. In one embodiment, the support body can be formed substantially from an ethylene-vinyl acetate (EVA) foam material. The support edge can form at least approximately a 30 degree arc of a circle. In another embodiment, the support body includes a beveled edge positioned between the first side and the support edge. In this embodiment, the beveled edge can be angled differently than each of the first side and the support edge.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

The present invention is directed toward a dynamic support block 10 (hereinafter sometimes referred to simply as a "support block") that is used for balance and dynamic support of a user during physical exercise and/or meditation. For example, the support block 10 can be used to support various body parts during Pilates, yoga, or other suitable exercise, as described below.

Figure 1:
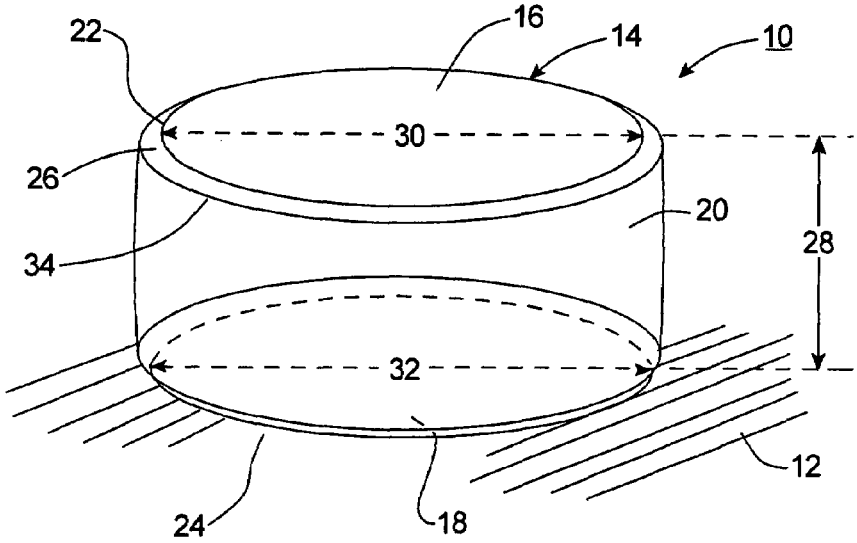
FIG. 1 is a perspective view of a support surface and a support block having features of the present invention, illustrated in a first position relative to the support surface.

FIG. 1 is a perspective view of one embodiment of the support block 10 resting on a support surface 12. The dimensions and shape of the support block 10 can vary widely. In the embodiment illustrated in FIG. 1, the support block 10 includes a support body 14 having a first side 16, a second side 18 partially shown in phantom, and a support edge 20.

In this embodiment, the first side 16 and the second side 18 have a substantially round or circular configuration. Further, the first side 16 and the second side 18 are substantially similar or identical in size. Alternatively, the first side 16 and the second side 18 can have different shapes than one another and/or can be different sizes from one another. In one embodiment, one or both of the first side 16 and the second side 18 are substantially planar. Alternatively, one or both of the first side 16 and the second side 18 can have a non-planar configuration. The first side 16 has a first perimeter 22 and the second side has a second perimeter 24.

In the embodiment illustrated in FIG. 1, the support edge 20 extends between the first perimeter 22 and the second perimeter 24. More specifically, in one embodiment, the support edge 20 extends from approximately the first perimeter 22 to approximately the second perimeter 24. In the embodiment illustrated in FIG. 1, the support body 14 includes a chamfer or beveled edge 26 positioned between the first perimeter 22 and the support edge 20, and between the second perimeter 24 and the support edge 20. As used herein, the terms chamfer and beveled edge are interchangeable. In this embodiment, the beveled edge 26 has an angle that is different than the first side 16 and the support edge 20.

In an alternative embodiment, the support body 14 does not include a beveled edge 26. In this alternative embodiment, the support edge 20 extends from the first perimeter 22 to the second perimeter 24. In certain embodiments, the support edge 20 is substantially perpendicular to one or both of the first side 16 and the second side 18. Alternatively, the support edge 20 can be non-perpendicular (e.g., an angle other than approximately 90 degrees) to the first side 16 and/or the second side 18.

In one embodiment, the support edge 20 is adapted so that at least a portion of the support edge 20 rollingly moves along the support surface 12 while supporting at least a portion of the weight of a user (not shown in FIG. 1). As provided herein, the dynamic back-and-forth rolling movement of the support edge 20 relative to the support surface 12 encourages the user to "learn" how to move the support block 10 relative to the support surface 12 without losing his or her balance. Because the support block 10 rollingly moves relative to the surface 16, the user can utilize different muscles or muscle groups while continually balancing and counterbalancing in order to maintain a particular position or pose. Additionally or alternatively, the user can sit atop the support block 10 in certain positions, or the user can position the support edge 20 against the user's back in certain other positions, as described in greater detail below.

In the embodiment illustrated in FIG. 1, the entire support edge 20 has a substantially consistent radius of curvature in a circumferential direction around the support body 14 so that the entire support edge 20 can continually rollingly move along the support surface 12 while supporting at least a portion of the weight of the user.

The dimensions of the support block 10 can vary. In various embodiments, the support edge 20 can have a width 28 that is less than a first diameter 30 of the first side 16 and/or a second diameter 32 of the second side 18. For example, in one non-exclusive embodiment, the width 28 of the support edge 20 can be approximately 4", and the first diameter 30 and/or the second diameter 32 can be approximately 8". This example is provided for illustrative purposes and is not intended to limit or restrict the size and/or shape of the support block 10 in any manner. In non-exclusive embodiments, the width 28 of the support edge 20 can be at least approximately 10%, 25%, 50%, 75% or 90% of the length of the diameter of the first diameter 30 and/or the second diameter 32. In another embodiment, the width 28 can be greater than the first diameter 30 and/or the second diameter 32.

In certain embodiments, the support edge 20 also has a length 34 that is oriented in a direction that is substantially perpendicular to the width 28. The length 34 of the support edge 20 is at least partially curved. In one embodiment, the length 34 can roughly track the shape of one or both of the first perimeter 22 and the second perimeter 24. Alternatively, the length of the support edge 20 can have somewhat of a hybridized shape relative to the first perimeter 22 and the second perimeter 24. In one embodiment, the width 28 is substantially uniform along the length 34 of the support edge 20. Alternatively, the width 28 can vary along the length 34 of the support edge 20. Further, the length 34 can be substantially uniform along the width 28 of the support edge 20. Alternatively, the length 34 can vary along the width 28 of the support edge 20.

As provided herein, in alternative embodiments, the support edge 20 can include one or more substantially linear or straight edges sections. For example, the support edge 20 can have a rectangular/brick-shaped, trapezoidal, triangular or any other appropriate configuration. In another embodiment, the support block 10 can combine both linear sections with curved sections. In certain embodiments, the support edge 20 of the support block 10 can have at least one arc shaped portion that can range from approximately 30 degrees to less than 360 degrees. In still other embodiments, the arc shaped portion can be less than approximately 30 degrees.

The support block 10 can be formed from one or more relatively rigid, lightweight memory foam plastic materials, such as ethylene vinyl acetate (EVA) foam, as one non-exclusive example. In one embodiment, the material(s) used to form the support block 10 is/are substantially resilient, and can be slightly compressed under the weight of a user. The material can have a memory, however, and can return to its original shape and size once the support block 10 is no longer compressed. Alternatively or additionally, the support block can be formed from other suitable materials, such as wood as one non-exclusive example. For instance, the support block can be formed from relatively sturdy, lightweight and/or soft woods such as bamboo, balsa, etc., or other suitable types of wood. In one embodiment, the support block 10 is homogeneously formed.

Figure 2A:
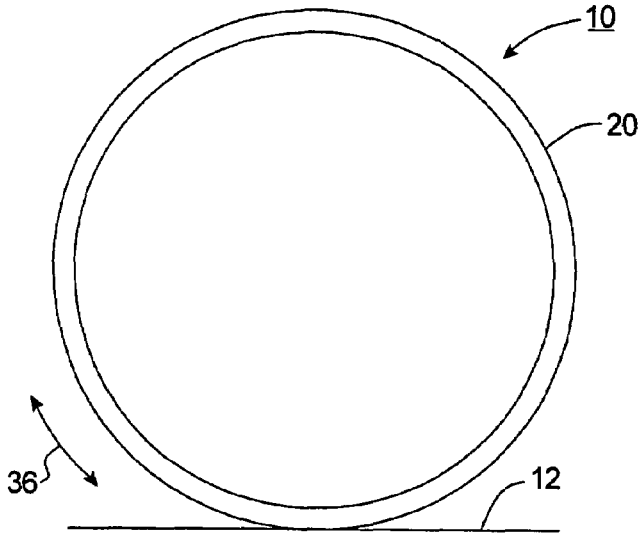
FIG. 2A is a top view of the support block illustrated in FIG. 1, illustrated in a second position relative to the support surface.

FIG. 2A is a top view of the support block 10 illustrated in FIG. 1, illustrated in a second position relative to the support surface 12. In the second position, the support edge 20 is in contact with the support surface 12 along the width 28 (illustrated in FIG. 1) of the support edge 20. In the first position, the support block 10 can rollingly be moved by the user along the support surface 12 in a clockwise or counterclockwise direction (illustrated by arrow 36).

Figure 2B:
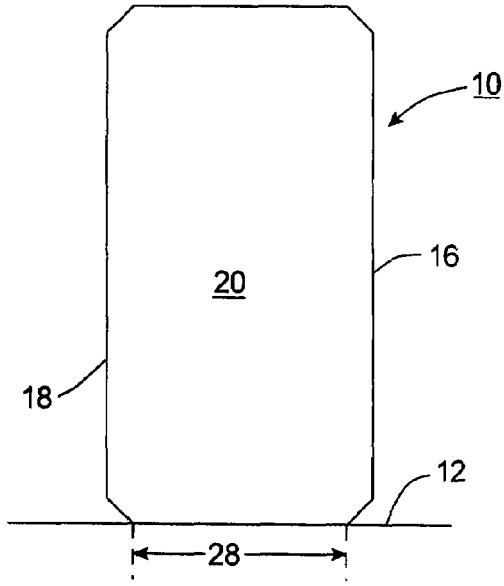
FIG. 2B is a side view of the support block illustrated in FIG. 1, illustrated in the second position relative to the support surface.

FIG. 2B is a side view of the support block 10 illustrated in FIG. 1, illustrated in the second position relative to the support surface 12. In FIG. 2B, the support block 10 is resting on the support surface 12 along the width 28 of the support edge 20. In this embodiment, the first side 16 and the second side 18 are illustrated in a substantially parallel orientation relative to one another, although this specific orientation is not a requirement.

Figure 2C:
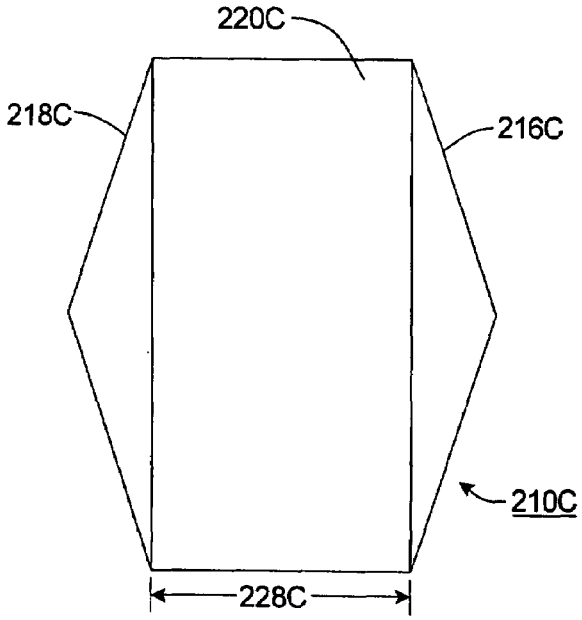
FIG. 2C is a side view of another embodiment of the support block.

FIG. 2C is a side view of another embodiment of the support block 210C. In this embodiment, the support block 210C includes a first side 216C, a second side 218C and a support edge 220C. In this embodiment, the first side 216C and/or the second side 218C can each have a somewhat conical shape so that the first side 216C and/or the second side 218C can each extend in an outwardly direction as illustrated in FIG. 2C. With this design, the support block 210C can have a greater structural rigidity when weight is placed on the support block 210C by the user. Additionally, or alternatively, the user can position the support block 210C with one of the sides 216C, 218C in contact with the support surface 212 so that the support block 210C rocks back and forth under the weight of the user, causing the user to use various muscles to compensate for the rocking motion of the support block 210C. The support edge 220C can be substantially similar to one or more of the support edges previously described herein. In this embodiment, the support edge 220C has a width 228C that is relatively uniform along the support edge 220C.

Figure 2D:
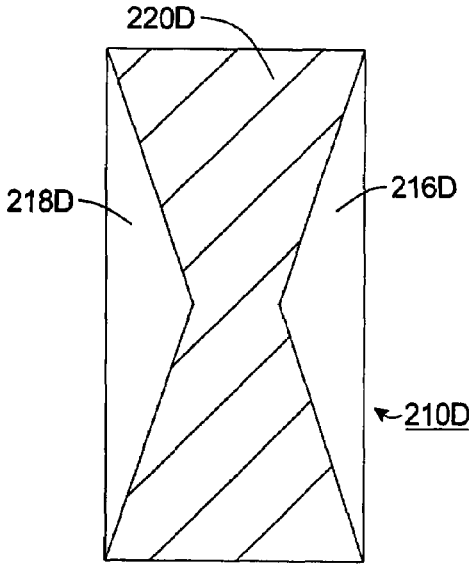
FIG. 2D is a cross-sectional view of yet another embodiment of the support block.

FIG. 2D is a side view of another embodiment of the support block 210D. In this embodiment, the support block 210D includes a first side 216D, a second side 218D and a support edge 220D. In this embodiment, the first side 216D and/or the second side 218D can each have a somewhat inversely conical shape so that the first side 216D and/or the second side 218D can each extend in an inwardly direction as illustrated in FIG. 2D. With this design, the support block 210D can be easier to grip by a user. The support edge 220D can be substantially similar to one or more of the support edges previously described herein.

Figure 2E:
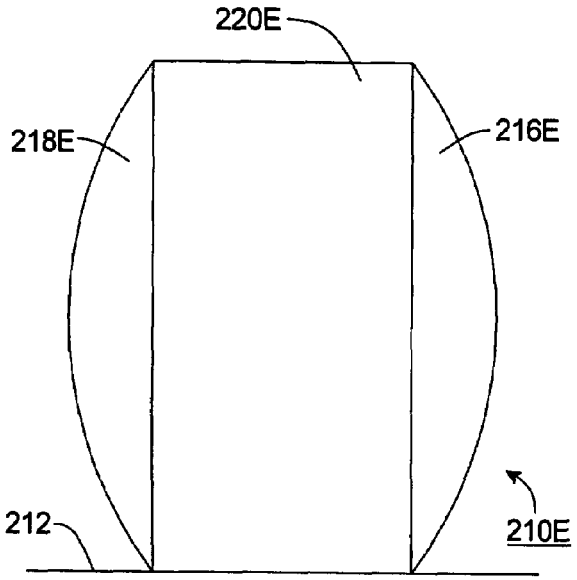
FIG. 2E is a side view of still another embodiment of the support block.

FIG. 2E is a side view of another embodiment of the support block 210E. In this embodiment, the support block 210E includes a first side 216E, a second side 218E and a support edge 220E. In this embodiment, the first side 216E and/or the second side 218E can each have a somewhat convex, dome-shaped configuration so that the first side 216E and/or the second side 218E can each extend in an outwardly direction as illustrated in FIG. 2E. With this design, the support block 210E can have a greater structural rigidity when weight is placed on the support block 210E by the user. Additionally, or alternatively, the user can position the support block 210E with one of the sides 216E, 218E in contact with the support surface 212 so that the support block 210E rollingly moves back and forth under the weight of the user, causing the user to use various muscles to compensate for the rolling motion of the support block 210E. The support edge 220E can be substantially similar to one or more of the support edges previously described herein. In this embodiment, the support edge 220E has a width 228E that is relatively uniform along the support edge 220E.

Figure 2F:
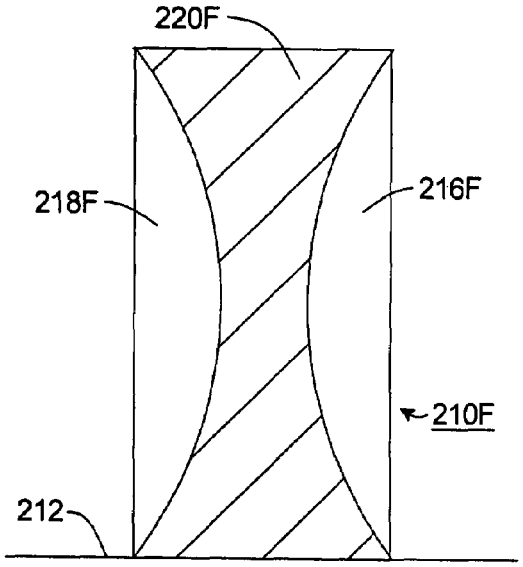
FIG. 2F is a cross-sectional view of still another embodiment of the support block.

FIG. 2F is a side view of another embodiment of the support block 210F. In this embodiment, the support block 210F includes a first side 216F, a second side 218F and a support edge 220F. In this embodiment, the first side 216F and/or the second side 218F can each have a somewhat concave, inverse dome-shaped configuration so that the first side 216F and/or the second side 218F can each extend in an inwardly direction as illustrated in FIG. 2F. With this design, the support block 210F can be easier to grip by a user. The support edge 220F can be substantially similar to one or more of the support edges previously described herein.

Figure 2G:
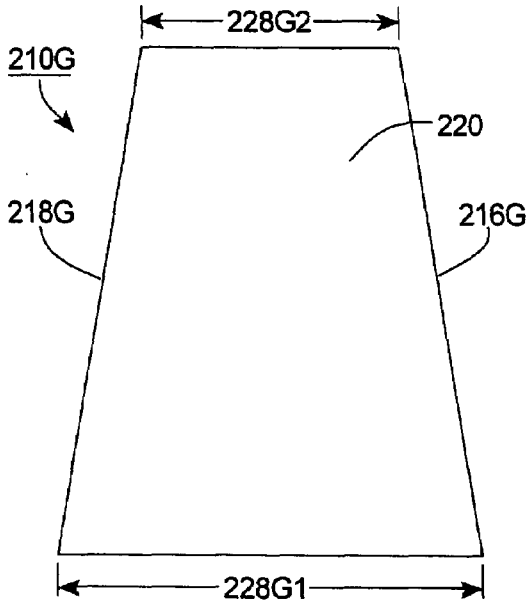
FIG. 2G is a side view of but another embodiment of the support block.

FIG. 2G is a side view of another embodiment of the support block 210G. In this embodiment, the support block 210G includes a first side 216G, a second side 218G and a support edge 220G. In this embodiment, the first side 216G and/or the second side 218G can be non-parallel with one another. In certain embodiments, the first side 216G and/or the second side 218G can be substantially circular or elliptical, although any suitable shape can be used for the first side 216G and the second side 218G. In this embodiment, the support edge 220G can have a plurality of widths, including 228G1 and 228G2, as just two examples of an infinite number of possible widths along the support edge 220G. With this design, as one potential benefit among many, the user can grip the support block 210G at a width along the support edge 220G that is most comfortable for the user.

Figure 3:
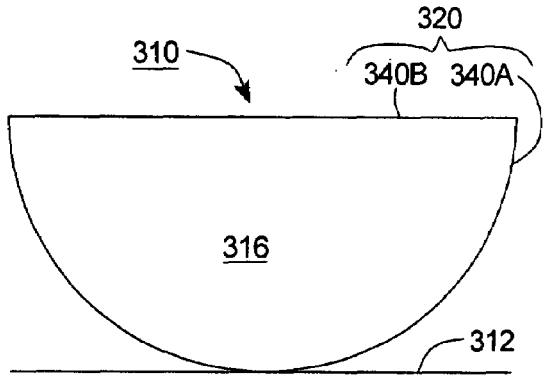
FIG. 3 is a side view of another embodiment of the support block.

FIG. 3 is a side view of another embodiment of the support block 310. In this embodiment, the first side 316 and/or the second side (not shown in FIG. 3) can have a substantially semicircular configuration. In this embodiment, the support edge 320 includes a first support section 338 and a second support section 340. The first support section 338 is curved and the second support section 340 has a substantially straight or linear configuration. As a result, the support edge 320 still maintains an at least partially curved configuration to provide dynamic, rolling support of the user during balance and exercise when the first support section 338 is positioned in contact with the support surface 312. Conversely, when the second support section 340 is in contact with the support surface 312, movement of the support block 310 is inhibited.

Figure 4:
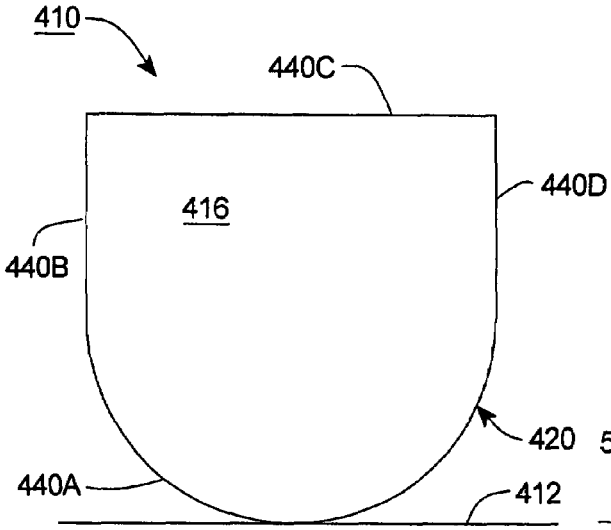
FIG. 4 is a side view of yet another embodiment of the support block.

FIG. 4 is a side view of another embodiment of the support block 410. In this embodiment, a portion of the first side 416 and/or a portion of the second side (not shown in FIG. 4) can have a substantially semicircular configuration. Further, a portion of the first side 416 and/or a portion of the second side can have a substantially rectangular configuration. In this embodiment, the support edge 420 includes a first support section 440A, a second support section 440B, a third support section 440C and a fourth support section 440D. The first support section 440A is curved. The second support section 440B, the third support section 440C and/or the fourth support section 440D can have substantially straight or linear configurations. As a result, the support edge 420 still maintains an at least partially curved configuration to provide dynamic, rolling support of the user during balance and exercise when the first support section 440A is positioned in contact with the support surface 412. Conversely, when any one of the remaining support sections 440B-440D is in contact with the support surface 412, movement of the support block 410 is inhibited.

Figure 5:
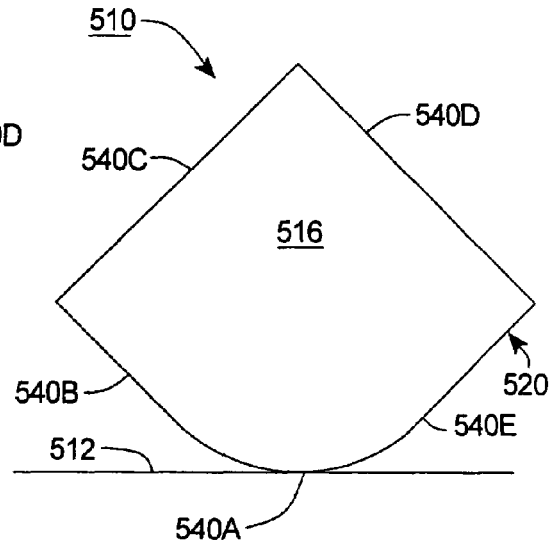
FIG. 5 is a side view of still another embodiment of the support block.

FIG. 5 is a side view of another embodiment of the support block 510. In this embodiment, the first side 516 and/or the second side (not shown in FIG. 5) can have a somewhat square configuration with one or more rounded corners. In this embodiment, the support edge 520 includes a first support section 540A, a second support section 540B, a third support section 540C, a fourth support section 540D and a fifth support section 540E. The first support section 540A is curved and can have an arc of less than approximately 180 degrees. In the embodiment illustrated in FIG. 5, the arc is approximately 90 degrees. The second support section 540B, the third support section 540C, the fourth support section 540D and/or the fifth support section 540E can have substantially straight or linear configurations. As a result, the support edge 520 still maintains an at least partially curved configuration to provide dynamic, rolling support of the user during balance and exercise when the first support section 540A is positioned in contact with the support surface 512. Conversely, when any one of the remaining support sections 540B-540E is in contact with the support surface 512, movement of the support block 510 is inhibited.

Figure 6:
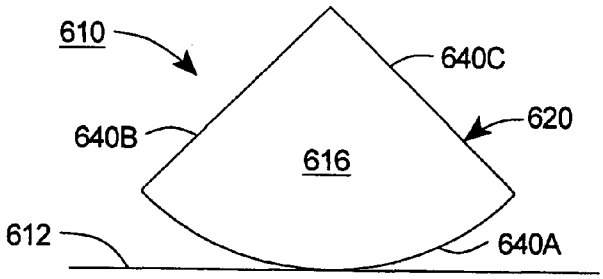
FIG. 6 is a side view of but another embodiment of the support block.

FIG. 6 is a side view of another embodiment of the support block 610. In one embodiment, the first side 616 and/or the second side (not shown in FIG. 6) can have a somewhat "quarter-round" configuration with one or more rounded corners. In this embodiment, the support edge 620 includes a first support section 640A, a second support section 640B and a third support section 640C. The first support section 640A is curved and can have an arc of less than approximately 180 degrees, for example. The second support section 640B and/or the third support section 640C can have substantially straight or linear configurations. As a result, the support edge 620 still maintains an at least partially curved configuration to provide dynamic, rolling support of the user during balance and exercise when the first support section 640A is positioned in contact with the support surface 612. Conversely, when any one of the remaining support sections 640B, 640C is in contact with the support surface 612, movement of the support block 610 is inhibited.

Figure 7:
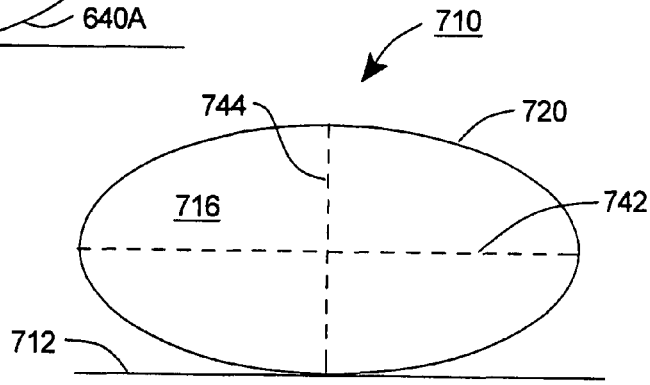
FIG. 7 is a side view of another embodiment of the support block.

FIG. 7 is a side view of another embodiment of the support block 710. In one embodiment, the first side 716 and/or the second side (not shown in FIG. 7) can have a somewhat elliptical configuration, having a major axis 742 and a minor axis 744. In this embodiment, the support edge 720 is continuously curved along the entire length of the support edge 720. With this design, depending upon the part of the support edge 720 that contacts the support surface 712, the user may need to alter his or her stance or position. In other words, the user can elect to position the support block 710 so to extend farther away from the support surface 712 or closer to the support surface 712 depending upon the orientation of the axes 742, 744 relative to the support surface 712.

Figure 8:
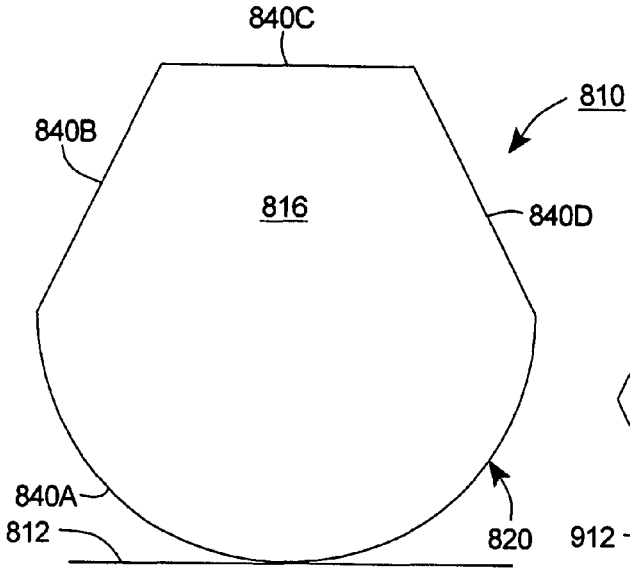
FIG. 8 is a side view of yet another embodiment of the support block.

FIG. 8 is a side view of another embodiment of the support block 810. In this embodiment, a portion of the first side 816 and/or a portion of the second side (not shown in FIG. 4) can have a substantially semicircular or otherwise curved configuration. Further, a portion of the first side 816 and/or a portion of the second side can have a substantially semi-hexagonal or multi-sided configuration such as that illustrated in FIG. 8. In this embodiment, the support edge 820 includes a first support section 840A, a second support section 840B, a third support section 840C and a fourth support section 840D. The first support section 840A is curved. In one embodiment, the second support section 840B, the third support section 840C and/or the fourth support section 840D can have substantially straight or linear configurations. As a result, the support edge 820 still maintains an at least partially curved configuration to provide dynamic, rolling support of the user during balance and exercise when the first support section 840A is positioned in contact with the support surface 812. Conversely, when any one of the remaining support sections 840B-840D is in contact with the support surface 812, movement of the support block 810 along the support surface 812 is inhibited.

Figure 9:
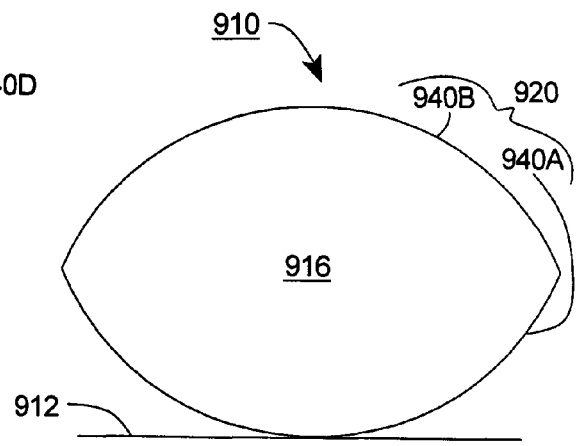
FIG. 9 is a side view of still another embodiment of the support block.

FIG. 9 is a side view of another embodiment of the support block 910. In one embodiment, the first side 916 and/or the second side (not shown in FIG. 9) can have a somewhat football-shaped configuration. In this embodiment, the support edge 920 includes a first support section 940A and a substantially similar or identical second support section 940B. Each of the support sections 940A, 940B are curved to allow dynamic, rolling support of the user during balance and exercise when either support section 940A, 940B is positioned in contact with the support surface 912.

Figure 10:
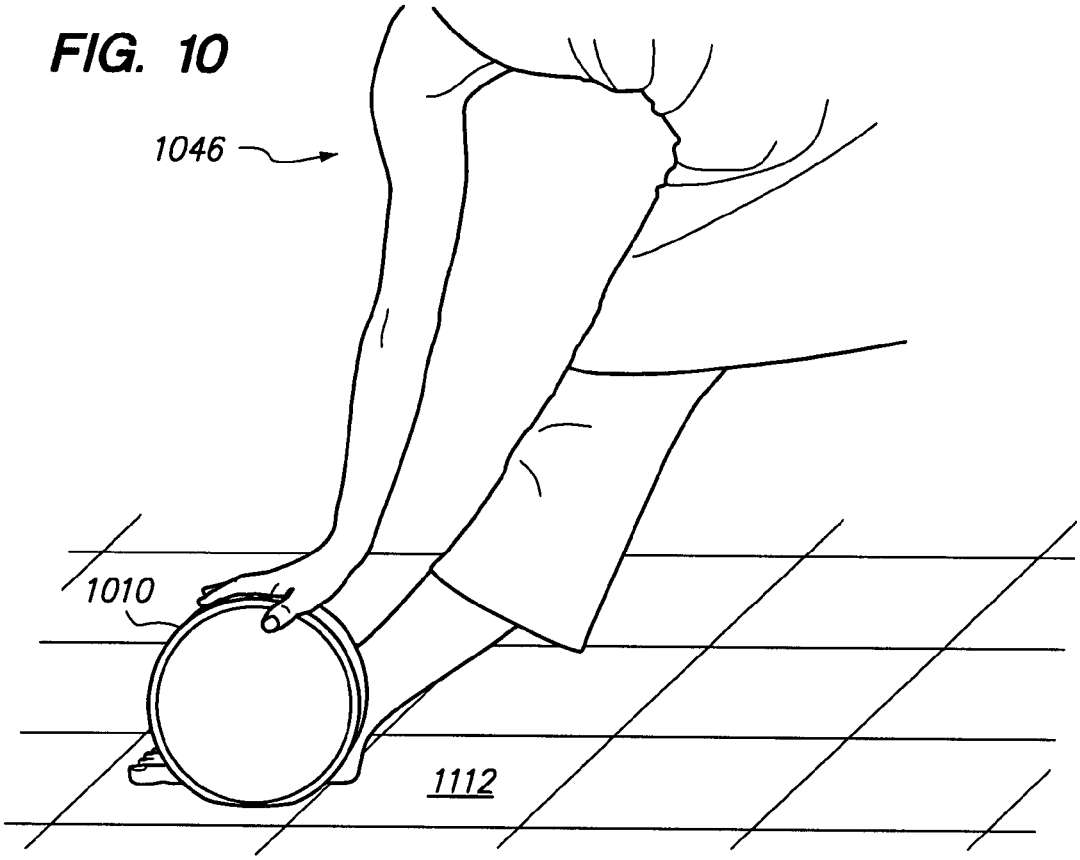
FIG. 10 is a side view of the support block in use by a user in a first position.

FIG. 10 is a side view illustrating one usage of the support block 1010 by a user 1046. The support block 1010 in FIG. 10 is representative of any support block having one or more features described herein. In this embodiment, the user 1046 is in a particular pose so that the user 1046 is gripping and placing weight onto the support block 1010. Additionally, because the support block 1010 is rollingly movable relative to the support surface 1012, the user 1046 must use different muscles to continually compensate for this movement. Therefore, because the support block 1010 is not static relative to the support surface 1012, the user 1046 must use a higher level of concentration and coordination to hold a pose. With this design, the user 1046 can derive a greater benefit from use of the support block 1010 described herein.

Figure 11:
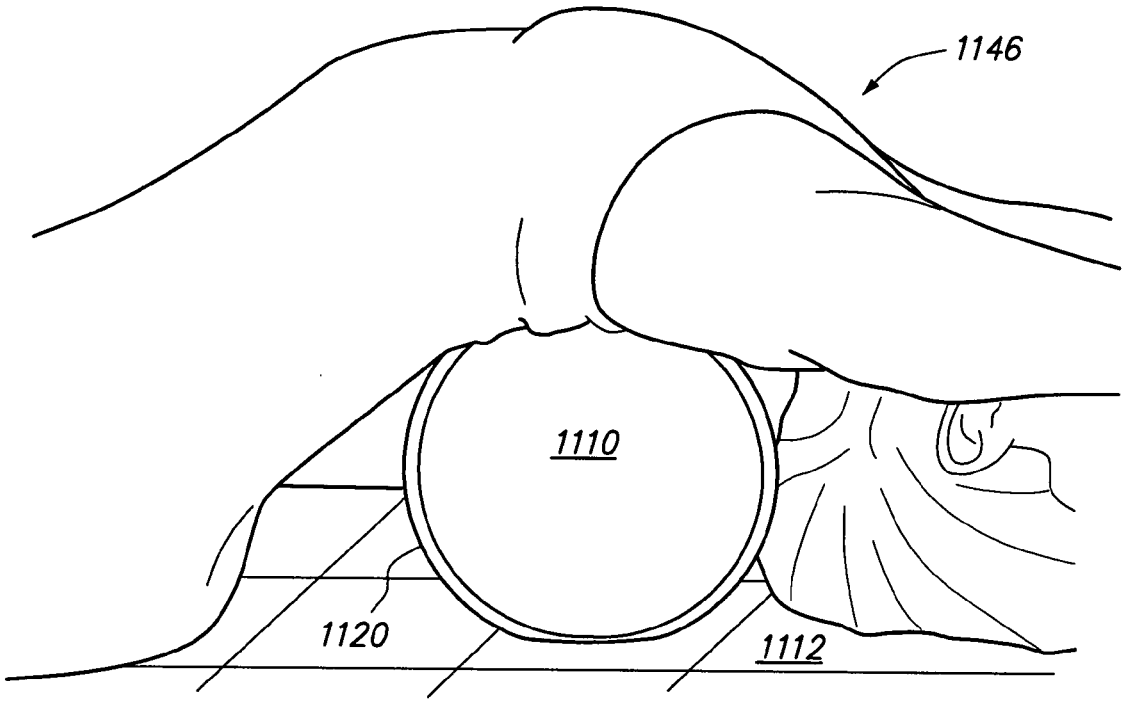
FIG. 11 is a side view of the support block in use by a user in a second position.

FIG. 11 is a side view illustrating another usage of the support block 1110 by a user 1146. In this embodiment, the support block 1110 can be positioned so that the support edge 1120 is in contact with the support surface 1112. The user can then position the curve of the support edge 1120 to support the back or spine of the user 1146 during various poses or exercises. Because the support block 1110 can rollingly move over the support surface 1112, the user 1146 can move back and forth with the movement of the support block 1110 without the user 1146 having to use his or her hands to reposition the support block 1110. With this design, greater comfort and convenience is derived by the user 1146.

It is understood that although a number of different embodiments of the support block 10 have been illustrated and described herein, one or more features of any one support block can be combined with one or more features of one or more of the other support blocks, provided that such combination satisfies the intent of the present invention.

While the particular support blocks as shown and disclosed herein is fully capable of obtaining the objects and providing the advantages herein before stated, it is to be understood that it is merely illustrative of the presently preferred embodiments of the invention and that no limitations are intended to the details of the methods, construction or design herein shown and described.

What is claimed is:

1. A support block for at least partially supporting the weight of a user above a support surface during exercise, the support block comprising:

a support body having (i) a substantially planar first side having a circular configuration, the first side having a first diameter, (ii) a substantially planar second side that is substantially parallel with the first side, the second side having a substantially similar configuration to the first side, (iii) a support edge that is positioned orthogonally to the first side and the second side, the support edge including (a) a width that is substantially perpendicular to the first diameter, the width being less than approximately the first diameter, and (b) a curved first section that forms at least a 90 degree arc of a circle, the first section rollingly contacting the support surface while the support body at least partially directly supports the weight of the user above the support surface, and (iv) a beveled edge positioned between the first side and the support edge, the beveled edge being angled differently than each of the first side and the support edge.

2. The support block of claim 1 wherein the support body is formed substantially from an ethylene-vinyl acetate foam material.

3. The support block of claim 1 wherein the support edge forms at least approximately a 180 degree arc of a circle.

4. The support block of claim 1 wherein the width of the support edge is approximately four inches.

5. The support block of claim 1 wherein the first diameter is approximately eight inches.

6. The support block of claim 1 wherein the support edge has a substantially consistent radius of curvature in a circumferential direction around the support body.

7. The support block of claim 1 wherein the support body is homogeneously formed.

8. The support block of claim 1 wherein the support body is homogeneously formed from a memory foam plastic material.

9. The support block of claim 1 wherein the first diameter is less than approximately 12 inches.

* * * * *